United States Patent [19]

Konda et al.

[11] Patent Number: 4,469,312

[45] Date of Patent: Sep. 4, 1984

[54] MELTING FURNACE OF A RIGID STRUCTURE

[75] Inventors: Koichi Konda; Shoji Shinohara, both of Kagawa, Japan

[73] Assignee: Mitsubishi Kinzoku Kabushiki Kaisha, Tokyo, Japan

[21] Appl. No.: 472,991

[22] Filed: Mar. 7, 1983

[30] Foreign Application Priority Data

Mar. 13, 1982 [JP] Japan ..... 57-40047

[51] Int. Cl.[3] ..... C21C 5/42

[52] U.S. Cl. ..... 266/99; 266/285; 432/251

[58] Field of Search ..... 266/285, 275, 286, 242, 266/99, 78, 80, 89, 96, 200, 282, 280, 206, 900, 901; 432/251, 252, 248

[56] References Cited

U.S. PATENT DOCUMENTS

| | | | |
|---|---|---|---|
| 1,448,194 | 3/1923 | Cassidy | 432/251 |
| 3,162,710 | 12/1964 | Anderson | 266/242 |
| 3,735,010 | 5/1973 | Turpin | 266/242 |
| 4,183,508 | 1/1980 | Michelet et al. | 266/242 |

*Primary Examiner*—L. Dewayne Rutledge
*Assistant Examiner*—S. Kastler
*Attorney, Agent, or Firm*—Cushman, Darby, Cushman

[57] ABSTRACT

A melting furnace of a rigid structure includes a hollow body for receiving a material to be melted, the body comprising bricks joined together. A shell of iron surrounds the brick body so as to restrain a thermal expansion of the brick body during an operation of the furnace. A heating device is mounted around the iron shell for heating it to control the degree of thermal expansion of the iron shell, thereby controlling compressive forces exerted by the iron shell on the brick body when the brick body is thermally expanded during the operation of the furnace.

3 Claims, 8 Drawing Figures

MELTING FURNACE OF A RIGID STRUCTURE

BACKGROUND OF THE INVENTION

1. Field of the Invention

This invention relates to a melting furnace of a rigid structure.

2. Prior Art

In the construction of a conventional melting furnace having a body made of bricks joined together, it is important that when metal such as copper is melted in the furnace, the molten metal is positively prevented from leaking through the joints between the bricks. For this reason, it is a common practice in the art to provide a melting furnace of a rigid structure. The melting furnace of this rigid structure comprises a shell of iron mounted around a peripheral wall of the furnace body made of bricks joined together. With this rigid construction, the iron shell serves to restrain a thermal expansion of the brick wall during an operation of the furnace to thereby exert predetermined compressive forces on the bricks forming the peripheral wall of the furnace body, so that the joints between the bricks are prevented from breaking or spliting, thereby ensuring that the molten metal in the furnace will not leak through the joints. For the purpose of maintenance of the furnace of the rigid structure, it is often necessary to allow the hot furnace to cool so as to determine whether the furnace needs repair. When the furnace of the rigid structure is subjected to a cycle of heating and cooling repeatedly, the amount of thermal expansion of the bricks forming the furnace body is gradually increased so that the compressive forces exerted by the iron shell on the bricks finally become excessive. This may cause the bricks to fracture under pressure. More specifically, when the furnace of the rigid structure is subjected to one cycle of heating and cooling under a predetermined load, the bricks become smaller due to creep shrinkage after they are allowed to cool to room temperatures. Although the bricks are thermally expanded during the heating of the furnace, they are subjected to such creep shrinkage because they are restrained by the iron shell. As shown in FIG. 1, this creep shrinkage is the total of an amount $l_1$ of creep shrinkage occuring during a period when the temperature of the bricks rises from a creep-starting temperature $T_{cr}$ to the maximum heating temperature $T_e$ and an amount $l_2$ of creep shrinkage occuring during a period when the bricks are maintained at the maximum heating temperature. Thus, the brick becomes smaller by the combined amounts $l_1$ and $l_2$ of creep shrinkage. However, in the case where this cycle of heating and cooling is repeated with the bricks under the predetermined pressure in contact with the molten metal such as copper, the molten metal penetrates into the bricks while the bricks are maintained at elevated temperatures. Therefore, as shown in FIG. 2, the amount L′ of shrinkage of each cooled brick is smaller than the amount L of its creep shrinkage, and the amount of subtraction of the amount L′ from the amount L is present as the residual expansion amount, as indicated by curve 1 in FIG. 2. In addition, when the furnace is heated again as indicated by curve 2 in FIG. 2, the impregnated metal in the brick is also thermally expanded so that a thermal expansion coefficient of the brick is increased. Due to the increase of this thermal expansion coefficient and the residual expansion amount, the maximum amount λ of expansion of the brick immediately before the occurrence of the creep shrinkage in the brick is caused to increase substantially each time the cycle of heating and cooling of the furnace is repeated, as indicated by curves 1 to 3 in FIG. 2. Therefore, even if the compressive forces exerted by the iron shell on the bricks after the furnace of the rigid structure reaches the maximum heating temperature are less than the fracture strength of the bricks due to the occurrence of the creep shrinkage in the bricks, the bricks are subjected to excessive compressive forces greater than the fracture strength during a period when the heating temperature of the furnace rises to its maximum heating temperature. This will result in the fracture of the bricks under pressure, and the melting furnace of the rigid structure will have a shortened service life. In addition, the fracture strength of the bricks is lowered gradually since the bricks are deteriorated with the lapse of time. Due to the lowering of the fracture strength of the bricks and the excessive compressive forces, the bricks forming the furnace body are liable to fracture under pressure, and the service life of the melting furnace of the rigid structure is further shortened.

SUMMARY OF THE INVENTION

It is therefore an object of this invention to provide a melting furnace of a rigid structure having means whereby compressive forces exerted by an iron shell on bricks forming a furnace body are reduced during an operation of the furnace, thereby preventing the bricks from fracture under pressure.

According to the present invention, there is provided a melting furnace of a rigid structure which comprises a hollow body for receiving a material to be melted, the body comprising bricks joined together; a shell of iron surrounding the brick body so as to restrain a thermal expansion of the brick body during an operation of the furnace; and a heating means mounted around the shell for heating the shell to control the degree of thermal expansion of the shell, thereby controlling compressive forces exerted by the shell on the brick body when the brick body is thermally expanded during the operation of the furnace.

DESCRIPTION OF THE PREFERRED EMBODIMENT

Figure 1A:
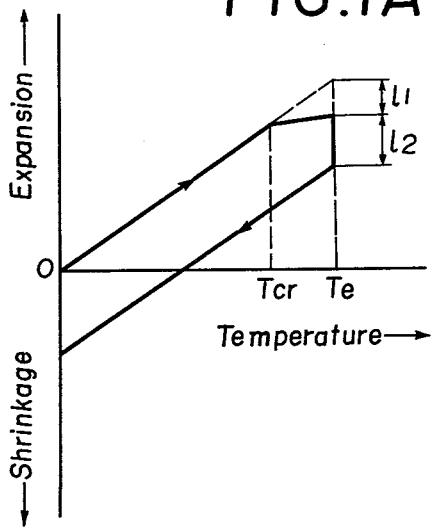
FIG. 1A is a diagrammatic illustration showing a relation between expansion and shrinkage of a brick when the brick is subjected to a cycle of heating and cooling under a predetermined load.
Figure 1B:
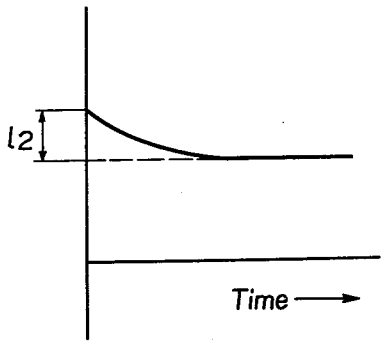
FIG. 1B is a diagrammatic illustration showing creep shrinkage of the brick.
Figure 2:
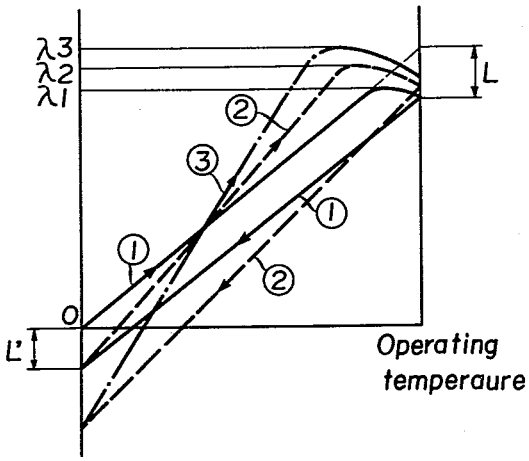
FIG. 2 is a diagrammatic illustration showing a relation between expansion and shrinkage of a brick in contact with molten copper when the brick is repeatedly subjected to a cycle of heating and cooling under a predetermined load.
Figure 3:
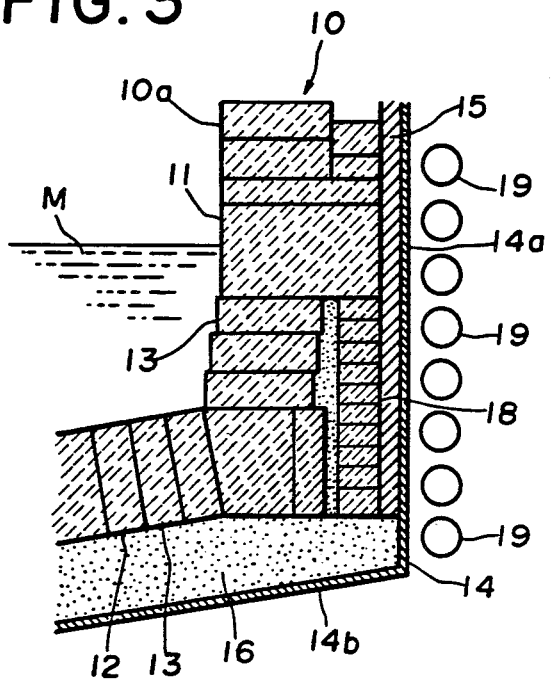
FIG. 3 is a cross-sectional view of a portion of a melting furnace provided in accordance with the present invention.

FIG. 3 shows a cross-section of a portion of a melting furnace 10 provided in accordance with the present invention. The furnace 10 comprises a hollow body 10*a* of a circular cross-section defined by a peripheral wall 11 and a bottom 12 joined to a lower end of the peripheral wall 11. As shown in FIG. 3, the furnace body 10*a* comprises a number of bricks 13 joined together. The furnace body 10*a* is enclosed by a shell 14 of iron except for its top. More specifically, the iron shell 14 has a peripheral portion 14*a* surrounding the peripheral wall 11 of the furnace body 10*a*, and a bottom portion 14*b* disposed in underlying relation to the bottom 12 of the furnace body 10*a*. An expansion-absorbing material 15 made for example of asbestos or glass wool is interposed between the peripheral wall 11 of the furnace body 10 and the peripheral portion 14*a* of the iron shell 14. A layer 16 of grains of magnesium oxide is interposed between the bottom 12 of the furnace body 10*a* and the bottom portion 14*b* of the iron shell 14. A castable refractory 18 is received in the lower half of the peripheral wall 11 of the furnace body 10*a*.

A heating means is provided for heating the iron shell 14. The heating means comprises a plurality of steam pipes 19 which are mounted around and adjacent to the peripheral portion 14*a* of the iron shell 14. The steam pipes 19 are connected to a source of steam 21 (FIG. 5) so that steam is adapted to flow through the steam pipes 19 to heat the iron shell 14.

Figure 4:
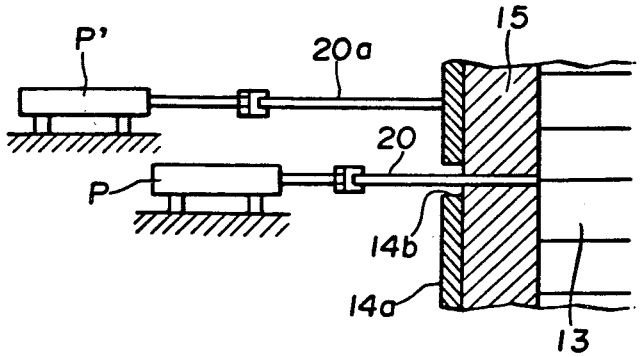
FIG. 4 is a fragmentary view of the melting furnace, showing detecting means.

A first detecting means is provided for detecting the degree of thermal expansion of the bricks 13 constituting the furnace body 10*a*. The first detecting means comprises a plurality of potentiometers P ($P_1$, $P_2$ . . . $P_n$) disposed around the peripheral portion 14*a* of the iron shell 14 in spaced relation to each other (FIG. 4). Each potentiometer P has a slidable rod 20 which passes through an aperture 14*b* formed in the iron shell 14 and extends through the expansion-absorbing material 15. The slidable rod 20 is held at its outer end in contact with the outer surface of the brick wall 11, the slidable rod 20 having at its inner end an electrical contact disposed in contact with an associated resistor. When the brick wall 11 of the furnace body 10*a* is thermally expanded, the slidable rod 20 is displaced or retracted so that the resistance value of the resistor is changed to detect the degree of the thermal expansion of the brick wall 11.

A second detecting means is also provided for detecting the degree of thermal expansion of the iron shell 14 heated by the steam pipes 19 and tensile expansion of the iron shell 14 caused by the thermal expansion of the brick. The second detecting means comprises a plurality of potentiometers P' ($P'_1$, $P'_2$ . . . $P'_n$) disposed around the iron shell 14. The potentiometers P' are identical in construction to and equal in number to the potentiometers P of the first detecting means and are disposed adjacent to them, respectively, so that each adjacent potentiometers P and P' constitute a pair of mating detecting devices. Each potentiometer P' of the second detecting means has a slidable rod 20*a* held in contact with the outer surface of the iron shell 14. When the iron shell 14 is thermally expanded, the slidable rod 20*a* is retracted or displaced to detect the degree of the thermal expansion of the iron shell 14.

Figure 5:
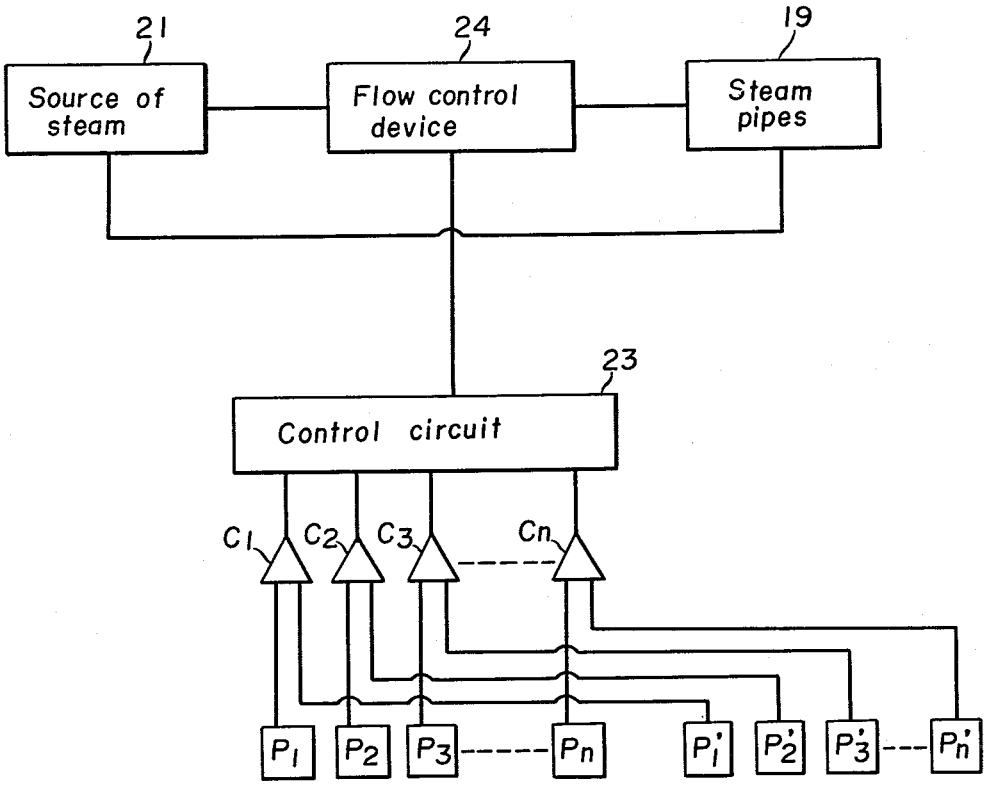
FIG. 5 is a block diagram of a control system for the melting furnace.

FIG. 5 shows a block diagram of a control system of the furnace 10. An output signal of the potentiometer $P_1$ is sent to one input terminal of a comparator $C_1$, the output signal being representative of the amount of displacement of the slidable rod 20. Also, an output signal of the potentiometer $P'_1$ is fed to the other input terminal of the comparator $C_1$, this output signal being representative of the amount of displacement of the slidable rod 20*a*. In response to these two output signals from the pair of potentiometers $P_1$ and $P'_1$, the comparator $C_1$ feeds an output signal to a control circuit 23 which output signal is representative of the difference between the displacement amount of the slidable rod 20 of the potentiometer $P_1$ and the displacement amount of the slidable rod 20*a* of the potentiometer $P'_1$.

Similarly, each other pair of mating potentiometers P and P' also deliver their respective output signals to the corresponding comparator C, and each comparator C delivers an output signal to the control circuit 23 as described above for the comparator $C_1$. In response to the output signals from the comparators $C_1$ to $C_n$, the control circuit 23 delivers an output signal to a flow control device 24 which output signal is representative of the average value of the difference represented by the output signals of the comparators $C_1$ to $C_n$. The flow control device 24 is mounted between the source of steam 21 and the steam pipes 19. In response to the output signal from the control circuit 23, the flow rate of steam passing through the steam pipes 19 is controlled by the flow control device 24 so that the degree of thermal expansion of the iron shell 14 is controlled generally in synchronism with the degree of thermal expansion of the brick wall 11 of the furnace 10. The downstream side of the steam pipes 19 is connected to the source of steam 21 through a condenser (not shown).

Figure 6:
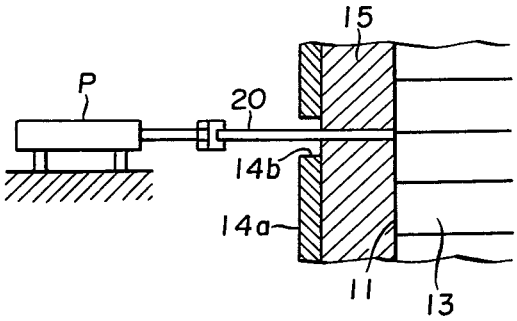
FIG. 6 is a fragmentary view of the mdlting furnace, showing a modified detecting means.
Figure 7:
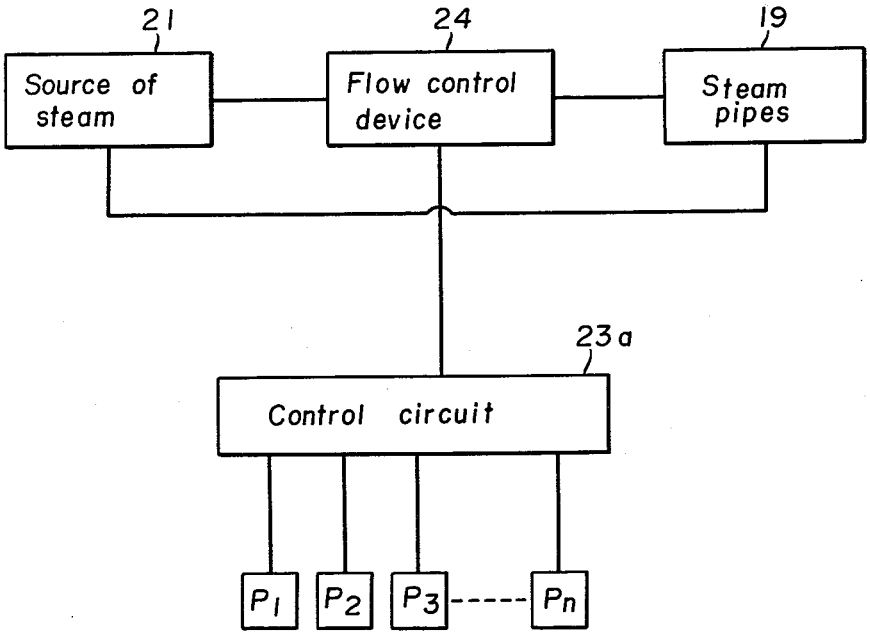
FIG. 7 is a block diagram of a modified control system for the melting furnace.

Alternatively, the above-mentioned detecting means can be of simplified construction. More specifically, according to a modified form of the invention shown in FIGS. 6 and 7, the second detecting means as described in the preceding embodiment is omitted. An output signal of each potentiometer P is sent to a control circuit 23*a*, the output signal being representative of the amount of displacement of the slidable rod 20 of each potentiometer P. In response to the output signals from the potentiometers $P_1$ to $P_n$, the control circuit 23*a* delivers an output signal to a flow control device 24 which output signal is representative of the average value of the displacement amounts of the slidable rods 20. In response to the output signal from the control circuit 23*a*, the flow control device 24 controls the flow rate of steam passing through the steam pipes 19 so that the degree of thermal expansion of the iron shell 14 is controlled generally in synchronism with the degree of thermal expansion of the brick wall 11 of the furnace.

When the melting furnace 10 is newly built, the interior of the furnace is first heated to a predetermined temperature by blasts of hot air or by the use of burners such as gas burners and oil burners. During the operation of the furnace, the heating of the furnace is effected mainly by the heat generated by the oxidation of pulverized metal or ore introduced into the furnace. Oil burners are used to provide an auxiliary fuel, the burners being attached to either the ceiling of the furnace or the side wall thereof. When the furnace is to be maintained at a predetermined temperature, the heat generated by the oxidation of the pulverized metal or ore is not utilized, and this is achieved by the oil burners.

The operation of the melting furnace 10 will now be described. As mentioned before, the compressive forces exerted by the iron shell 14 on the bricks 13 of furnace body 10*a* becomes greater each time the cycle of heating and cooling of the furnace 10 is repeated. When the compressive forces become excessive during the operation of the furnace, steam is passed through the steam pipes 19 to heat the iron shell 14 to thermally expand it. Thus, since the iron shell 14 restraining the bricks 13 are thermally expanded, the compressive forces exerted on the bricks 13 will not become excessive, thereby keeping these compressive forces to a proper degree. Therefore, the bricks 13 are not subjected to fracture under pressure even during a time period when the temperature of the cooled furnace 10 rises to the maximum heating temperature during the operation thereof. In the case where the compressive forces exerted by the iron shell 14 on the bricks 13 becomes unduly low due to the creep shrinkage of the bricks, the amount of the steam passing through the steam pipes is reduced by the flow control device 24 to lower the temperature of the iron shell 14 to thermally contract it so that the compressive forces exerted on the bricks are increased to a proper level.

An example of the operation of the furnace 10 will now be described. The furnace 10 was designed so that the compressive forces exerted on the bricks 13 would become 2 kg/cm$^2$ after the temperature of the furnace 10 reaches its maximum heating temperature at a first operation of the furnace. The actual compressive forces after the furnace temperature reached the maximum temperature at the first operation was 2.1 kg/cm$^2$ which approximated the estimated value of 2.0 kg/cm$^2$. Then, the cycle of heating and cooling of the furnace 10 was repeated. At the tenth operation of the furnace, during the rising of the furnace temperature to its maximum heating temperature, the maximum compressive forces exerted on the bricks 13 were 13 to 14 kg/cm$^2$ which was greater than the fracture strength of the bricks (12 kg/cm$^2$). The compressive forces exerted on the bricks after the completion of the creep shrinkage were 12 kg/cm$^2$. Then, the steam was passed through the steam pipes 19 to raise the temperature of the iron shell 14 from 30° to 160° C. to thermally expand it. Thereafter, the furnace 10 was heated. In this case, the maximum compressive forces exerted on the bricks 13 during the rising of the furnace temperature to its maximum heating temperature were 10 kg/cm$^2$. After the completion of the creep shrinkage of the bricks 13, the amount of the steam through the steam pipes was reduced so that the temperature of the rion shell 14 was reduced to 50° C. to reduce its thermal expansion, thereby adjusting the compressive forces to 11.5 kg/cm$^2$.

As described above, with the melting furnace according to the present invention, the thermal expansion of the iron shell surrounding the furnace body is controlled by the amount of the steam passing through the steam pipes, so that the compressive forces exerted by the iron shell on the bricks can be kept to the optimum level. Therefore, even if the amount of expansion of the bricks is gradually increased each time the cycle of heating and cooling of the furnace is repeated, the bricks are positively prevented from fracture under pressure. Thus, the furnace of the rigid structure can be used for a prolonged period of time.

While the furnace of the rigid structure according to the present invention has been specifically shown and described herein, the invention itself is not to be restricted by the exact showing of the drawings or the description thereof. For example, while the heating means for controlling the temperature of the iron shell comprises the plurality of steam pipes, the steam pipes may be replaced by other suitable heating means such as a heat jacket mounted around the iron shell. Further, the steam pipes 19 may be also arranged adjacent to the bottom portion 14*b* of the iron shell 14.

What is claimed is:

1. A melting furnace of a rigid structure comprising:

(a) a hollow body for receiving a material to be melted, said body comprising bricks joined together;

(b) a shell of iron surrounding said brick body so as to restrain a thermal expansion of said body during an operation of said furnace; and (c) a heating means mounted around said shell for heating said shell; and (d) means for controlling said heating means in accordance with the degree of thermal expansion of said shell, thereby controlling compressive forces exerted by said shell on said brick body when said brick body is thermally expanded during the operation of said furnace;

said control means comprising a detecting means for producing a detecting signal representative of the degree of thermal expansion of said brick body, and a control circuit responsive to said detecting signal for controlling the operation of said heating means to heat said shell in such a manner that the thermal expansion of said shell is carried out generally in synchronism with the thermal expansion of said brick body.

2. A melting furnace of a rigid structure comprising:

(a) a hollow body for receiving a material to be melted, said body comprising bricks joined together;

(b) a shell of iron surrounding said brick body so as to restrain a thermal expansion of said body during an operation of said furnace; and (c) a heating means mounted around said shell for heating said shell; and (d) means for controlling said heating means in accordance with the degree of thermal expansion of said shell, thereby controlling compressive forces exerted by said shell on said brick body when said brick body is thermally expanded during the operation of said furnace;

said control means comprising a first detecting means for producing a first detecting signal representative of the degree of thermal expansion of said brick body, a second detecting means for producing a second detecting signal representative of the degree of thermal expansion of said shell, means responsive to said first and second detecting signals for producing a control signal representative of the difference between the thermal expansions of said brick body and said shell, and a control circuit responsive to said control signal for controlling the operation of said heating means to heat said shell in such a manner that the thermal expansion of said shell is carried out generally in synchronism with the thermal expansion of said brick body.

3. A melting furnace of a rigid structure comprising:

(a) a hollow body for receiving a material to be melted, said body comprising bricks joined together;

(b) a shell of iron surrounding said brick body so as to restrain a thermal expansion of said body during an operation of said furnace; and (c) a heating means mounted around said shell for heating said shell; and (d) means for controlling said heating means in accordance with the degree of thermal expansion of said shell, thereby controlling compressive forces exerted by said shell on said brick body when said brick body is thermally expanded during the operation of said furnace;

said heating means comprising a plurality of steam pipes connectable to a source of steam.

* * * * *